US006637342B1

(12) United States Patent
Jennings et al.

(10) Patent No.: US 6,637,342 B1
(45) Date of Patent: Oct. 28, 2003

(54) CONVEYOR CARRIER

(75) Inventors: Keith Jennings, Brighton, MI (US); Robert Goryca, Livonia, MI (US); Gary Ramse, Commerce Township, MI (US); Ricky L. Brown, Howell, MI (US); David K. Meissner, Brighton, MI (US)

(73) Assignee: Jervis B. Webb Company, Farmington Hills, MI (US)

( * ) Notice: Subject to any disclaimer, the term of this patent is extended or adjusted under 35 U.S.C. 154(b) by 0 days.

(21) Appl. No.: 09/665,761

(22) Filed: Sep. 20, 2000

Related U.S. Application Data

(60) Provisional application No. 60/154,957, filed on Sep. 21, 1999.

(51) Int. Cl.[7] ..... B61B 10/04

(52) U.S. Cl. ..... 104/172.3; 104/172.1; 104/172.2; 104/172.5; 198/465.1

(58) Field of Search ..... 104/172.3, 172.1, 104/172.2, 172.5, 96, 140; 198/465.1

(56) References Cited

U.S. PATENT DOCUMENTS

| | | | | |
|---|---|---|---|---|
| 1,149,919 A | * | 8/1915 | Keinanen | 104/172.3 |
| 2,657,666 A | | 11/1953 | Fowler | |
| 2,965,043 A | * | 12/1960 | Klamp et al. | 104/88 |
| 3,156,193 A | * | 11/1964 | Anderson, Jr. et al. | 104/88 |
| 3,189,158 A | | 6/1965 | Lucas | |
| 3,262,397 A | * | 7/1966 | Bradt | 104/88 |
| 3,518,946 A | * | 7/1970 | Kavieff | 104/88 |
| 3,783,991 A | | 1/1974 | McCahon et al. | |
| 3,799,327 A | * | 3/1974 | Schultz | 104/172.3 |
| 4,180,152 A | | 12/1979 | Sefcik | 198/377 |
| 4,264,001 A | | 4/1981 | Jensen et al. | |
| 4,275,807 A | | 6/1981 | Mohn et al. | |
| 4,352,330 A | * | 10/1982 | Tupper | 104/96 |
| 4,382,500 A | | 5/1983 | Oyama et al. | |
| 4,438,701 A | * | 3/1984 | Murai et al. | 104/172.3 |
| 4,513,682 A | | 4/1985 | Otocki | |
| 4,548,135 A | | 10/1985 | Kupczyk | 104/135 |
| 4,564,100 A | * | 1/1986 | Moon | 198/465.1 |
| 4,567,979 A | | 2/1986 | Hoehn | 198/750 |
| 4,811,685 A | | 3/1989 | Murai | |
| 4,958,975 A | * | 9/1990 | Vaccaro et al. | 104/172.3 |
| 5,115,758 A | | 5/1992 | Suzuki et al. | |
| 5,195,437 A | | 3/1993 | Wallace et al. | |
| 5,195,630 A | * | 3/1993 | Donovan et al. | 104/172.3 |
| 5,303,655 A | | 4/1994 | Summa et al. | |
| 5,549,050 A | * | 8/1996 | Rhodes | 104/172.3 |

FOREIGN PATENT DOCUMENTS

| | | |
|---|---|---|
| DE | 3806347 | 9/1989 |
| DE | 3831275 | 3/1990 |

OTHER PUBLICATIONS

PCT International Search Report, International Application No. PCT/US00/25705, International Filing Date: Sep. 20, 2000, entitled "Conveyor Carrier" 4 pages.

* cited by examiner

*Primary Examiner*—S. Joseph Morano
*Assistant Examiner*—Lars A. Olson
(74) *Attorney, Agent, or Firm*—Dickinson Wright PLLC

(57) ABSTRACT

The present invention is directed to a conveyor assembly and carrier for use with a conveyor wherein the carrier includes a frame having a longitudinal axis, a first pair of load wheels rotatably coupled to the frame, and a first pair of stabilizer wheels positioned laterally outward of the first pair of load wheels and rotatably coupled to the frame. The conveyor includes the carrier, a drive, and a stabilizer track having first and second channels spaced from one another. The first pair of stabilizer wheels are disposable for movement within the channels.

23 Claims, 4 Drawing Sheets

CONVEYOR CARRIER

REFERENCE TO RELATED APPLICATION

This application claims the benefit of U.S. Provisional Application No. 60/154,957, filed Sep. 21, 1999.

BACKGROUND OF THE INVENTION

1. Technical Field

The present invention generally relates to conveyors and, more particularly, to a conveyor having a carrier adapted to be coupled to a workpiece and drivably engageable by a chain.

2. Discussion

Conveyors are widely used to move workpieces through manufacturing and assembly operations. Examples of such applications include coating or painting systems where the carrier is coupled to the workpiece and engageable with a drive chain. While a variety of conveyor, carrier, and other assemblies are used in the art to convey workpieces through assembly and manufacturing environments, a need exists for carrier assemblies configured to provide greater stability and flexibility in positioning the carrier and the workpieces relative to the chain. The stability of the carrier and workpiece are particularly important when the center of gravity of this assembly increases in distance from the support surface or when the carrier is moved through horizontal or vertical curves.

Many conveyor carriers include wheels that ride on a bearing surface to movably support the carrier and attached workpiece. While a variety of carrier and wheel configurations are used in the art, a need exists for a configuration that permits the carrier to move smoothly through horizontal turns and vertical curves while providing stable support for the workpiece. Another important operational criteria of the conveyor system is that the carriers should be easily re-spaced along the drive chain while the conveyor is in use. The structure providing the additional stability should not impact the spacing flexibility of the overall system.

Finally, in many applications it is desirable to change the orientation of the workpiece relative to the carrier travel path in order to simplify the performance of a production task on the workpiece. While many prior art systems have attempted to address this concern, the solutions have often times been ineffective or overly complex. Accordingly, a need exists for a conveyor system, including a carrier configuration, that provides increased stability without impacting the ease of re-spacing the carriers and that provides for reorientation of the workpiece relative to the carrier.

SUMMARY OF THE INVENTION

One object of the present invention is to provide a stable carrier for moving a workpiece through an assembly or manufacturing operation.

A further object of the present invention is to provide a stabilizer track configuration that provides the improved stability while also allowing the carrier to be removed from engagement and repositioned relative to the drive chain.

Yet another object of the present invention is to provide a rotator assembly for simply and efficiently rotating a workpiece coupled to the carrier to a desired orientation.

A still further object of the present invention is to provide a carrier assembly with each of the above benefits.

In view of the above, the present invention is directed to a conveyor and carrier for use with conveyor wherein the carrier includes a frame having a longitudinal axis, a first pair of load wheels rotatably coupled to the frame, and a first pair of stabilizer wheels positioned laterally outward of the first pair of load wheels and rotatably coupled to the frame. The conveyor includes the carrier, a drive, and a stabilizer track having first and second channels spaced from one another. The first pair of stabilizer wheels are disposable for movement within the channels.

Further scope of applicability of the present invention will become apparent from the following detailed description, claims, and drawings. However, it should be understood that the detailed description and specific examples, while indicating preferred embodiments of the invention, are given by way of illustration only, since various changes and modifications within the spirit and scope of the invention will become apparent to those skilled in the art.

BRIEF DESCRIPTION OF THE DRAWINGS

The present invention will become more fully understood from the detailed description given here below, the appended claims, and the accompanying drawings in which:

DETAILED DESCRIPTION OF THE PREFERRED EMBODIMENT

The following detailed description and the appended drawings describe the conveyor of the present invention coupled to a workpiece for moving the workpiece through a coating or paint application. It should be appreciated that the description and illustrations are for exemplary purposes only and that the present invention may be used in a variety of applications and may be modified in a variety of ways not specifically described herein without departing from the scope of the invention as defined by the appended claims.

Figure 1:
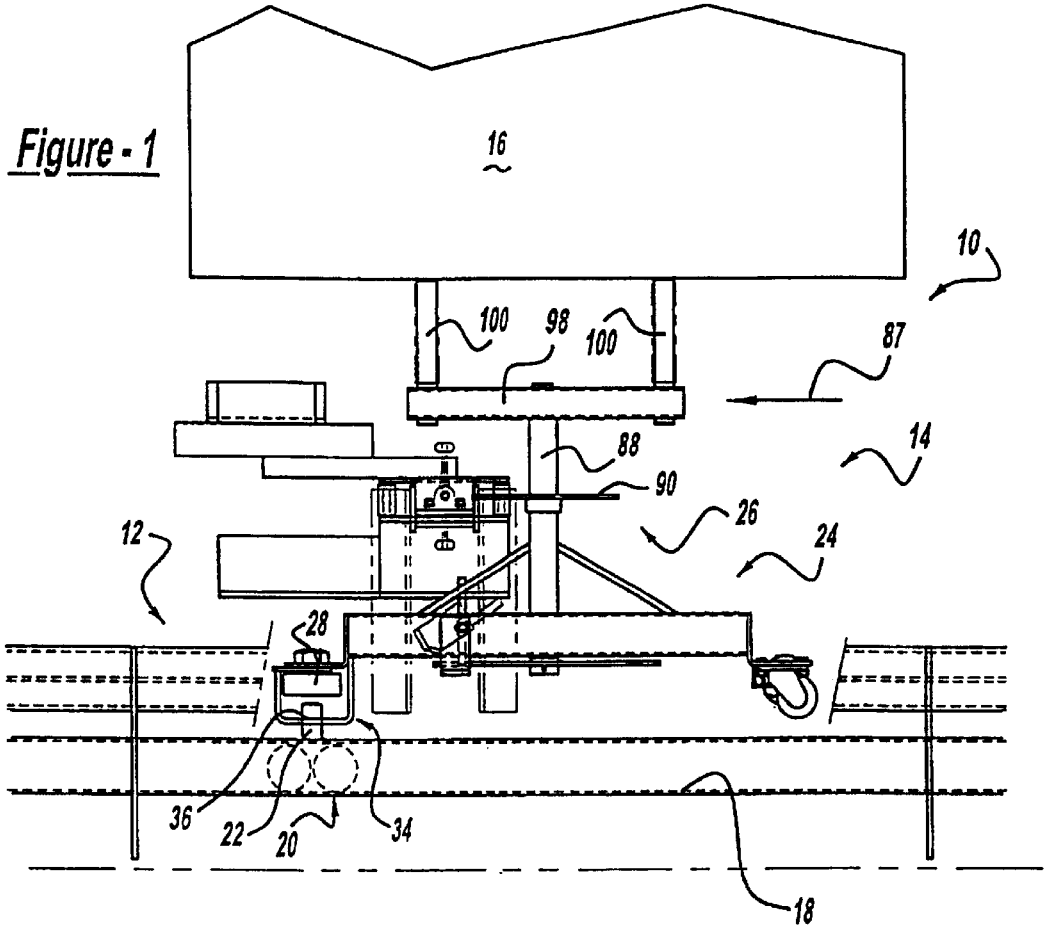
FIG. 1 is a side elevational view of the conveyor according to the present invention with a segment of the stabilizer track removed for clarity.
Figure 3:
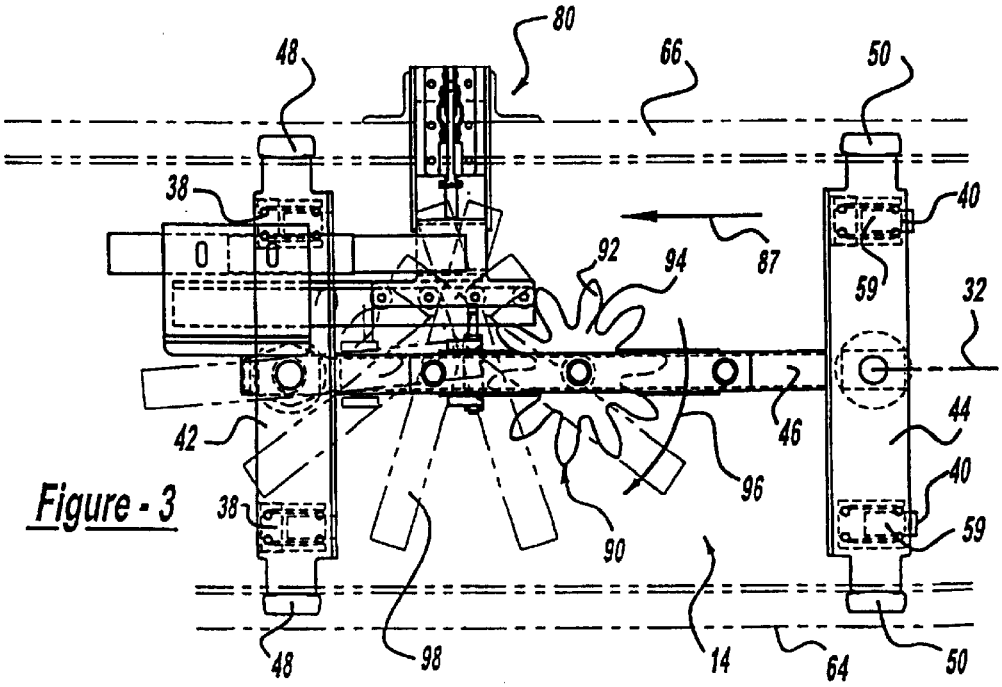
FIG. 3 is a top plan view of the conveyor shown in FIG. 1 illustrating the rotation of the workpiece support assembly as the carrier moves past the rotator.
Figure 2:
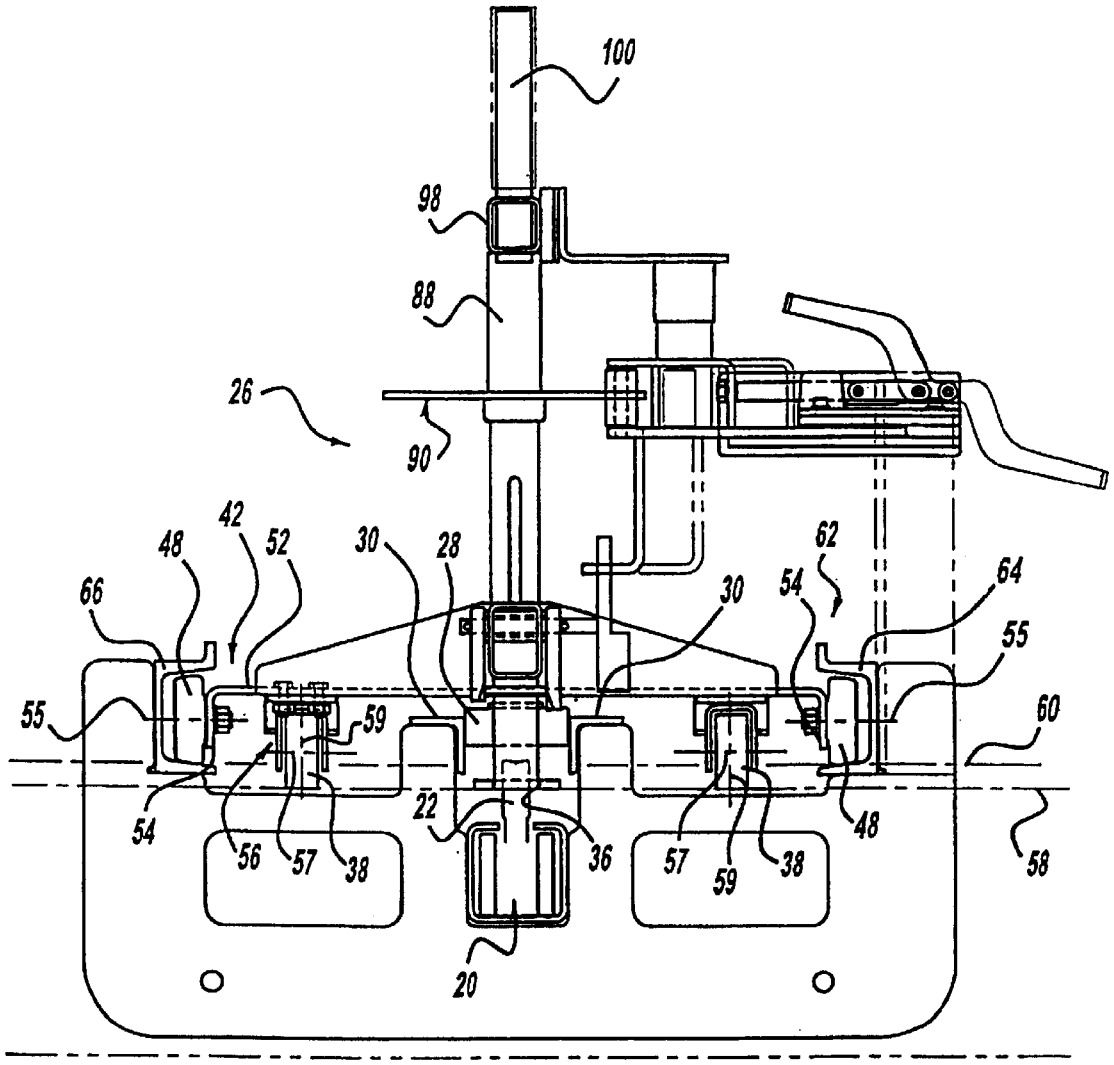
FIG. 2 is a front elevational view of the conveyor shown in FIG. 1.
Figure 4:
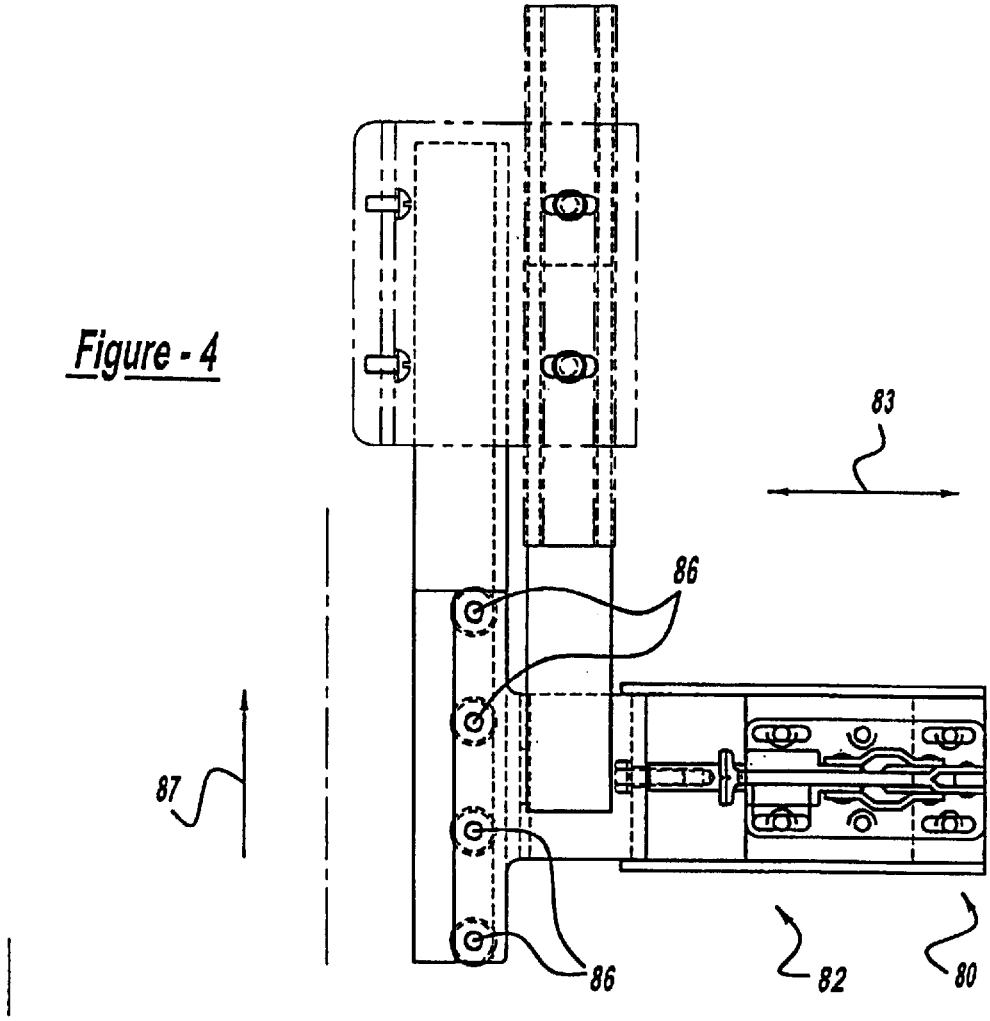
FIG. 4 is a top plan view of the rotator.
Figure 5:
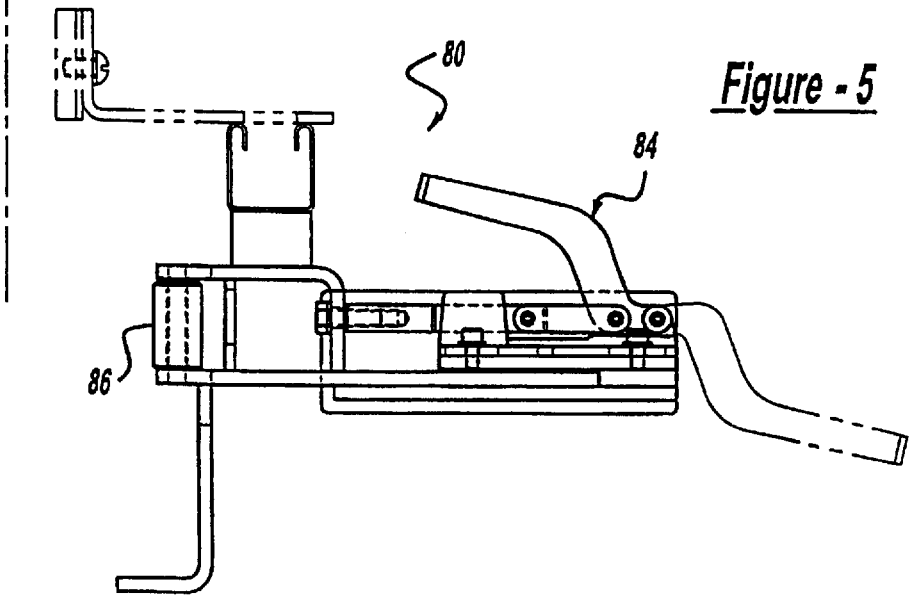
FIG. 5 is a front elevational view of the rotator shown in FIG. 4.

Turning now to the figures, FIGS. 1–3 illustrate a conveyor assembly 10 that includes a track system 12 and a carrier 14 adapted to be coupled to a workpiece 16. The track system 12 includes a drive track 18 and a chain 20 disposed for movement within the drive track. The chain 20 includes pusher dogs 22 extending above the drive track 18 to engage and drive the carrier 14 as hereinafter described. While the chain is described and illustrated herein as an endless Unibilt® chain such as that manufactured by Jervis B. Webb, the assignee of the present application those skilled in the art will appreciate that a variety of drive chains, belts, and the like may be used without departing from the scope of the invention. The conveyor assembly is illustrated as an inverted application where the workpiece is supported above the drive chain and, as is known in the art, the conveyor includes a drive assembly for moving the chain and a take-up for maintaining the proper chain tension.

The conveyor commonly includes a plurality of carriers each connected to the chain at selected pusher dogs and therefore at predetermined intervals. A single pusher dog, carrier, and workpiece is illustrated in FIG. 1. The carrier 14 includes a carrier frame 24 coupled for movement with the pusher dog 22 and a support assembly 26 fixed for movement with the frame and supporting the workpiece 16. As is best illustrated in FIGS. 1 and 2, the carrier 14 is centered above the drive chain 20 and includes a guide roller 28 rotatably coupled to the frame and positioned between guide flanges 30 to restrict movement of the carrier perpendicular to its longitudinal axis 32 (FIG. 3). A drive bracket 34 is fixed to the frame 24 and includes a hole 36 that is configured to accommodate the pusher dog 22.

As noted above, the carrier of the present invention provides a stable structure for supporting the workpiece for movement with the chain. The carrier frame 24 includes front and rear cross bars 42 and 44, respectively, interconnected by a longitudinal load bar 46. As is most clearly illustrated with respect to the front cross bar 42 shown in FIG. 2, the front and rear cross bars each preferably include a horizontal plate 52 that terminates at its lateral ends in downwardly depending legs 54. The carrier also includes front and rear pans of inner load wheels 38 and 40 and front and rear pairs of outer stabilizer wheels 48 and 50 each rotatably coupled to front and rear frame cross bars 42 and 44, respectively. More particularly, the stabilizer wheels 48 and 50 are coupled to the legs 54 for rotation about a fixed pin axis 55 while the pairs of load wheels 38 and 40 are rotatably coupled to the horizontal plate 52 by a caster mounting assembly 56 that permits the wheels to rotate about axes 57 and 59.

When it is desirable to have the stabilizer wheels support the frame, such as in straight sections and vertical curves, a stabilizer track 62 is provided to receive the wheels 48 and 50. The stabilizer track 62 includes first and second channels 64 and 66 (FIGS. 2 and 3) which are spaced from one another and parallel to the longitudinal axis 32 of the carrier. The channels 64 and 66 are configured to vertically restrain the carrier during operation while the operative engagement of the guide roller 28 with the guide flanges 30 provides horizontal restraint. The front and rear pairs of load wheels 38 and 40 each define a load plane 58 (FIG. 2) and the front and rear pairs of stabilizer wheels 48 and 50 each define a stabilizer plane indicated by reference numeral 60 that is positioned vertically above the load plane 58. Due to the preferred vertical separation between the load plane 58 and the stabilizer plane 60, the load wheels 38 are raised out of rolling engagement with the carrier support surface when the stabilizer wheels 48 rollingly engage the track 62 (FIG. 2). Accordingly, the carrier configuration permits the load wheels 38 to support the carrier and workpiece for movement with the chain in areas where a stabilizer track is absent, such as where the carrier is traversing a horizontal curve. Conversely, in areas where additional stability is desirable or the flexibility of the caster assembly is unnecessary, the stabilizer track 62 may be provided such that the stabilizer wheels 48 rollingly support the carrier within the channels 64 and 66. Based on this description, as well as the appended drawings and claims, those skilled in the art will appreciate that the conveyor of the present invention may include sections with and without the stabilizer track as needed to capitalize on the addition degree of freedom provided by the caster mounted load wheels and the stability provided by the stabilizer wheels. As a result, the loadings on the load wheels 38 and 40 can be eliminated in straight sections and vertical curves thereby decreasing the wear on the load wheels and the caster mounting assembly 56.

Figure 6:
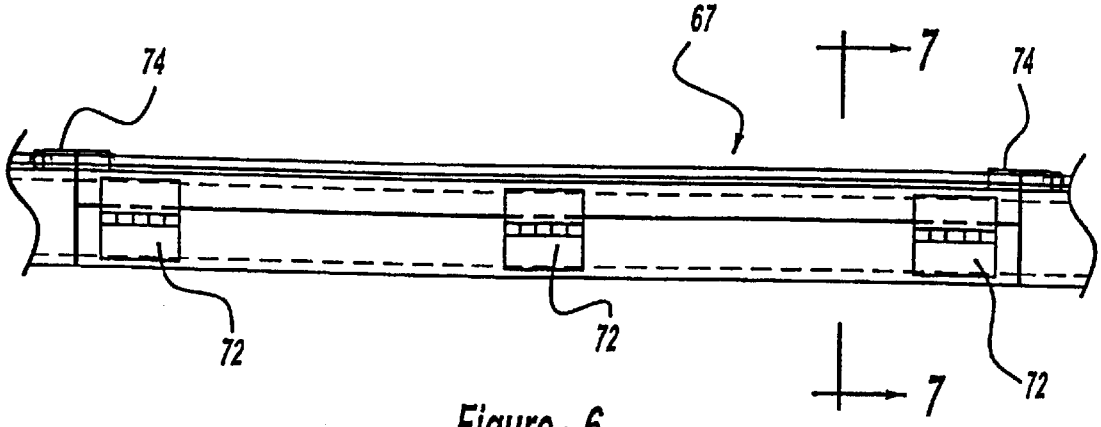
FIG. 6 is a side elevational view of an installation gate in the stabilizer track.
Figure 7:
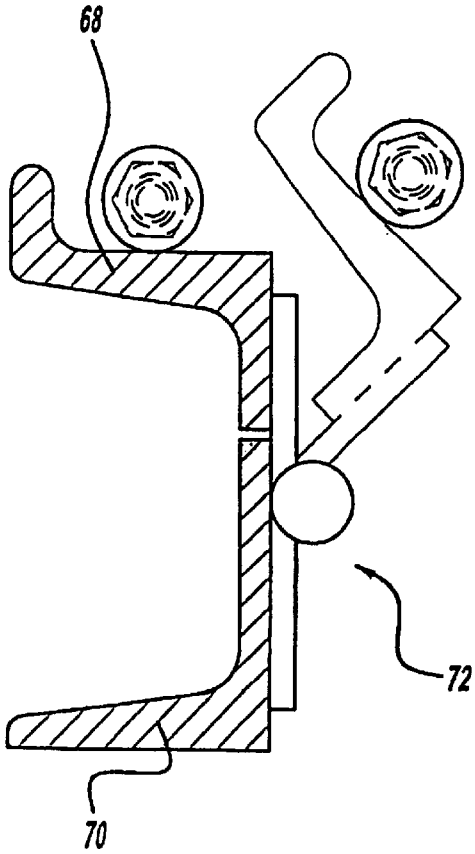
FIG. 7 is a sectional view taken along the line 7—7 in FIG. 6 and illustrating that an upper segment of a channel of the stabilizer track is movable between a closed position and an open position.

In certain instances, it may be desirable to re-space the carriers within an area where the stabilizer wheels are disposed within a stabilizer track 62. Accordingly, each of the channels 64 and 66 are configured to include an installation gate 67 wherein the carrier can be vertically displaced relative to the drive chain to permit the carrier to be removed from engagement with the chain and easily repositioned to redefine the carrier intervals. More particularly, each channel includes an upper segment 68, a lower segment 70, and a hinge 72 pivotably intercoupling the upper and lower segments to permit the upper segment to be moved between a closed position and an open position (FIGS. 6 and 7). Locks 74 are preferably included with the channels to maintain the upper segments in their closed positions during operation of the conveyor. The locks can be of any suitable configuration and preferably include a pin that is slidable between locked and unlocked positions.

With the above description in mind, those skilled in the art should appreciate that the present invention provides a stable carrier configuration that is movable in driving engagement with the drive chain to permit movement of the workpiece by the drive chain. The invention also permits the respective carriers to be removed from operative engagement with the drive chain by moving the upper segments from their closed position to their open position and vertically displacing the carrier relative to the drive chain to remove the pusher dog 22 from the hole 36.

As noted above, the present invention also includes a rotator that allows for workpiece rotation while the carrier is in motion. The rotator is selectively engageable with the carrier to provide a predetermined magnitude of rotation as the carrier passes the rotator. The rotator may be maintained in a retracted position if no workpiece rotation is desired.

As is best illustrated in FIGS. 2–5, the conveyor assembly 10 includes a rotator assembly 80 having a slide 82 movable in the direction of arrow 83 between an engaging position and a retracted position through movement of a handle 84. A plurality of engagement rollers 86 are coupled to the forward segment of the slide and aligned parallel to the carrier travel path 87. The support assembly 26 of the carrier 14 includes a rotatable upper shaft 88 and a rotator plate 90 fixed for rotation with the shaft 88. The plate 90 has a plurality of fingers 92 extending radially from a hub 94 such that when the slide 82 is in its engaging position the engagement rollers 86 are positioned in the path of the fingers 92. As a result, as the shaft 88 moves past the slide 82, the rollers 86 engage the fingers 92 causing the plate 90 and the shaft 88 to rotate in the direction indicated by arrow 96. The workpiece 16 is coupled to rotate with the shaft 88 via cross member 98 and support legs 100. Accordingly, the workpiece 16 rotates with the cross member 98 (FIG. 3) as the carrier 14 movies past the rotator assembly 80. It should be appreciated that the number and/or spacing of the engagement rollers or fingers may be varied to cause the desired degree of rotation of the workpiece as the carrier passes the slide. Moreover, if no rotation is needed, the slide may be maintained in its retracted position where the rollers 86 are spaced a sufficient distance from the shaft 88 so as not to engage the fingers 92. Additionally, it should be appreciated that while the slide is shown as being manually manipulatable by the handle 84, numerous configurations generally known in the art may be incorporated into the invention to permit automatic controlled movement of the slide between its engaging and retracted positions.

The foregoing discussion discloses and describes an exemplary embodiment of the present invention which includes a carrier configuration that provides increased carrier stability throughout the carrier travel path or in areas where increased stability is needed, permits the carriers to be removed from operative engagement with the drive chain when the stabilizer wheels are rollingly supported by tracks, and provides a simplified and effective rotator assembly for changing the orientation of the workpiece relative to the carrier. Notwithstanding the exemplary embodiments described above, one skilled in the art will readily recognize from such discussion, and from the accompanying drawings and claims that various changes, modifications and variations can be made therein without departing from the true spirit and fair scope of the invention as defined by the following claims.

What is claimed is:

1. A carrier for a conveyor system having a track and a support surface, said carrier comprising:

a frame having a longitudinal axis;

a first pair of load wheels coupled to move with the frame, depending downward from the frame, being rotatable about substantially horizontal and vertical axes and defining a load plane; and a first pair of stabilizer wheels coupled to move with the frame, depending downward from the frame, being rotatable about a substantially horizontal axis, and defining a stabilizer plane, said stabilizer plane spaced above said load plane such that said load wheels do not engage the support surface when said stabilizer wheels engage the track, and wherein one of said first pair of stabilizer wheels and said first pair of load wheels are positioned laterally outward of the other of said first pair of stabilizer wheels and said first pair of load wheels.

2. The carrier of claim 1 wherein each of said first pair of stabilizer wheels are rotatable only about said substantially horizontal axis.

3. The carrier of claim 1 wherein said first pair of stabilizer wheels are positioned laterally outward of said first pair of load wheels.

4. The carrier of claim 2 wherein said frame includes a front cross bar and wherein said first pair of load and stabilizer wheels are coupled to said front cross bar.

5. The carrier of claim 4 wherein said frame includes a lower plate having side legs and wherein said first pair of stabilizer wheels are coupled to said side legs.

6. The carrier of claim 4 wherein said frame further includes a rear cross bar and a load bar intercoupling said front and rear cross bars and wherein said carrier further includes a second pair of load wheels rotationally coupled to said rear cross bar and a second pair of stabilizer wheels positioned laterally outward of said second pair of load wheels and rotationally coupled to said rear cross bar.

7. The carrier of claim 4 further including a second pair of load wheels rotationally coupled to said frame and a second pair of stabilizer wheels positioned laterally outward of said second pair of load wheels and rotationally coupled to said frame.

8. The carrier of claim 4 wherein said frame includes a drive bracket having a hole adapted to drivably engage a pusher dog.

9. The carrier of claim 8 wherein said drive bracket is fixed to said front cross bar and centered on said longitudinal axis.

10. The carrier of claim 1 wherein said stabilizer track includes first and second channels spaced from one another, said first pair of stabilizer wheels being disposable for movement within said channels, and wherein said load wheels are out of engagement with the support surface when said stabilizer wheels are disposed for movement in the track.

11. The carrier of claim 1 further includes a support shaft rotatably coupled to said frame and adapted to be coupled to a workpiece, said support shaft including a rotator having a plurality of fingers extending radially from said shaft.

12. A conveyor comprising:

a drive;

a carrier adapted to be drivably engageable with said drive, said carrier including a frame having a longitudinal axis, a first pair of load wheels coupled to move with the frame, depending downward from the frame, and being rotatable about substantially horizontal and vertical axes, and a first pair of stabilizer wheels coupled to move with the frame, depending downward from the frame, and being rotatable about a substantially horizontal axis, one of said first pair of stabilizer wheels and said first pair of load wheels positioned laterally outward of the other of said first pair of stabilizer wheels and said first pair of load wheels; and a stabilizer track having first and second channels spaced from one another, said first pair of stabilizer wheels being disposable for movement within said channels.

13. The conveyor of claim 12 wherein said stabilizer track includes an installation gate wherein each of said first and second channels include an upper segment, a lower segment, and a hinge pivotally coupling said upper segment to said lower segment for movement between a closed position and an open position, said upper segment limiting vertical movement of said stabilizer wheels when said upper segment is in said closed position, said upper segment being removed from operative engagement with said stabilizer wheels to permit removal of said stabilizer wheels from said stabilizer track when said upper segment is in said open position.

14. The conveyor of claim 13 wherein said drive includes a chain having a pusher dog disposable within a hole in said carrier frame for driving engagement with said frame and wherein said carrier is removable from driving engagement with said pusher dog through vertical displacement of said carrier relative to said chain when said upper segment is in said open position.

15. The conveyor of claim 11 further including a rotator slide that is movable between an engaging position and a retracted position, wherein said carrier includes a support shaft rotatably coupled to said frame and adapted to support a workpiece, wherein said support shaft includes a plurality of radially extending fingers, and wherein said slide extends into a travel path of said fingers to rotate said shaft as said shaft moves past said slide when said slide is in said engaging position.

16. The conveyor of claim 14 wherein said slide includes a plurality of engagement rollers aligned parallel to said travel path and wherein each of said rollers engages a finger as said shaft moves past said slide when said slide is in said engaging position.

17. A conveyor comprising:

a drive;

a carrier operatively engaging said drive and including a frame and a support shaft rotatably coupled to said frame, said support shaft including a plurality of radially extending fingers; and a rotator slide movable between an engaging position and a retracted position, said slide extending into a travel path of said fingers to rotate said shaft as said shaft moves past said slide when said slide is in said engaging position.

18. The conveyor of claim 17 wherein said slide includes a plurality of engagement rollers aligned parallel to said travel path and wherein each of said rollers engages a finger as said shaft moves past said slide when said slide is in said engaging position.

19. A conveyor comprising:

a drive;

a carrier adapted to be drivably engageable with said drive, said carrier including a frame having a longitudinal axis, a first pair of load wheels rotatably coupled to said frame, and a first pair of stabilizer wheels rotatably coupled to said frame, one of said first pair of stabilizer wheels and said first pair of load wheels positioned laterally outward of the other of said first pair of stabilizer wheels and said first pair of load wheels; and a stabilizer track having first and second channels spaced from one another, said first pair of stabilizer wheels being disposable for movement within said channels, said stabilizer track further including an installation gate wherein each of said first and second channels include an upper segment, a lower segment, and a hinge pivotally coupling said upper segment to said lower segment for movement between a closed position and an open position, said upper segment limiting vertical movement of said stabilizer wheels when said upper segment is in said closed position, said upper segment being removed from operative engagement with said stabilizer wheels to permit removal of said stabilizer wheels from said stabilizer track when said upper segment is in said open position.

20. The conveyor of claim 12 said first pair of load wheels define a load plane, wherein said first pair of stabilizer wheels define a stabilizer plane, and wherein said stabilizer plane is above said load plane so that said load wheels are positioned out of engagement with any support surface when said stabilizer wheels are disposed for movement within said channels.

21. A conveyor system including:

a first conveyor section with a stabilizer track;

a second conveyor section;

a carrier movable in said first and second conveyor sections and including a frame having a longitudinal axis;

a first pair of load wheels coupled to move with the frame, depending downward from the frame, being rotatable about substantially horizontal and vertical axes, and defining a load plane; and a first pair of stabilizer wheels coupled to move with the frame, depending downward from the frame, being rotatable about a substantially horizontal axis, and defining a stabilizer plane above said load plane so that when said carrier is in said first conveyor section said stabilizer wheels are engageable with the stabilizer track to rollingly support said carrier with said load wheels being positioned out of rolling engagement with any carrier support surface, one of said first pair of stabilizer wheels and said first pair of load wheels positioned laterally outward of the other of said first pair of stabilizer wheels and said first pair of load wheels.

22. The conveyor system of claim 21 wherein said first pair of stabilizer wheels are positioned laterally outward of said first pair of load wheels.

23. The conveyor of claim 21 wherein said stabilizer track includes first and second channels spaced from one another, said first pair of stabilizer wheels being disposable for movement within said channels when said carrier is in said first conveyor section.

* * * * *